US006422045B1

(12) United States Patent
Morita et al.

(10) Patent No.: US 6,422,045 B1
(45) Date of Patent: Jul. 23, 2002

(54) COMPOUND NEEDLE OF KNITTING MACHINE

(75) Inventors: Toshiaki Morita, Kaiso-gun (JP); Klaus Ruoff, Albstadt (DE)

(73) Assignees: Shima Seiki Mfg., Ltd., Wakayama (JP); Groz-Beckert KG, Albstadt (DE)

( * ) Notice: Subject to any disclaimer, the term of this patent is extended or adjusted under 35 U.S.C. 154(b) by 0 days.

(21) Appl. No.: 09/958,827

(22) PCT Filed: Apr. 12, 2000

(86) PCT No.: PCT/JP00/02411

§ 371 (c)(1),
(2), (4) Date: Oct. 15, 2001

(87) PCT Pub. No.: WO00/63476

PCT Pub. Date: Oct. 26, 2000

(30) Foreign Application Priority Data

Apr. 15, 1999 (JP) ..... 11-108545

(51) Int. Cl.[7] ..... D04B 35/06
(52) U.S. Cl. ..... 66/120
(58) Field of Search ..... 66/116, 120, 123

(56) References Cited

U.S. PATENT DOCUMENTS 1,673,634 A * 6/1928 Page ..... 66/120
3,584,481 A * 6/1971 Hayashi ..... 66/120
4,043,153 A * 8/1977 Linder et al. ..... 66/120
5,937,673 A * 8/1999 Shima ..... 66/120
6,233,977 B1 * 5/2001 Schuler et al. ..... 66/120

FOREIGN PATENT DOCUMENTS

JP 2531535 6/1996
JP 2676179 7/1997

* cited by examiner

*Primary Examiner*—Danny Worrell
(74) *Attorney, Agent, or Firm*—Wenderoth, Lind & Ponack, L.L.P.

(57) ABSTRACT

A compound needle has blades of a slider having tongues formed by two superposed blades accommodated in a blade accommodating groove formed in a needle body. The blades are provided with bends to bring side surfaces of the blades accommodated in the blade groove in the needle body into press-contact with side walls of the groove. Front end portions of the blades can thus be held in positions that are equally divided to the right and left with respect to the widthwise direction of the blade groove from a widthwise center of the groove to more reliably center the blades in the blade groove.

16 Claims, 7 Drawing Sheets

COMPOUND NEEDLE OF KNITTING MACHINE

TECHNICAL FIELD

The present invention relates to a compound needle comprising a needle body and a slider to be placed on a needle bed of a knitting machine. More particularly, the present invention relates to a compound needle of the type where tongues of a slider are composed of two superposed blades.

BACKGROUND ART

A compound needle is known which comprises a needle body having a hook at a front end thereof and a slider and is so structured that the needle body and the slider can move relative to each other to open and close the hook. The applicant of this application previously proposed this type of compound needle in Japanese Patent Application No. Hei 10-109675 in the title of the invention of "Compound Needle of Flat Knitting Machine".

In the known compound needle, two blades of the slider are accommodated in a superposed state in a blade groove formed in the needle body. The blades are formed to have a thickness smaller than the width of the groove so as to define gaps between the blades and side walls of the groove so that they are supported in the groove in such a manner as to be freely movable forward and backward therealong. This may cause the blades to be unstably positioned with respect to the widthwise direction of the blade groove to only the extent corresponding to the gaps.

This raises a difficulty in centering the blades in the blade groove. This problem becomes prominent particularly when a stitch loop is rested on the tongues at the front ends of the blades that are under large lateral tension to the stitch loop from the knitting fabric.

When the blades are under unstable centering and are out of position in a lateral direction from the center of the groove, the problem may arise that when the slider moves forward, the blades may collide with or pass along one side of the hook without being forked by an end of the hook, to hinder the proper action that the tongues are forked at the front ends thereof by abutment with the end of the hook, so as to hold the hook in sandwich relation from both sides thereof and close it. This may create possible drawbacks in the durability of the needle and the knitting operation.

Even when the blades are forked by the end of the hook and properly actuated, the forked blades are each extended straight in an oblique direction along the sides of the hook at a loop transferring position into which the blades are further moved forward beyond the hook. As a result of this, the forked blades are expanded to the right and left at the front end portion thereof in a sector form when viewed from the top. This may create the following problem when the compound needles thus designed are used with a flat knitting machine having a pair of spaced apart, front and back needle beds on which knitting members such as sinkers and loop pressers are positioned in the vicinity of the compound needles and are moved forward and backward with respect to a needle gap between the needle beds. When transferring the loops, the blades come close to the knitting members to occlude the space for the loops resting on the tongues to be transferred to receiving needles, and as a result of this, there a drawback may arise during the knitting operation.

OBJECTIVES OF THE INVENTION

The objective of the present invention is to make centering the blades of the compound needle in the blade groove formed in the needle body more reliable. In addition, the objective of the present invention is to suppress outward expansion of the front end portions of the blades when guided to the loop transferring position beyond the hook.

SUMMARY OF THE INVENTION

According to the present invention a compound needle comprises a needle body having a hook at a front end thereof and a slider having tongues formed by two superposed blades. The needle body and the slider can be freely moved forward and backward individually in the state in which the blades of the slider are supported in a blade groove formed in the needle body. A centering means brings side surfaces of the blades in the blade groove into press-contact with side walls of the blade groove of the needle body so that front end portions of the blades can be held in positions that are equally divided to the right and left from a widthwise center of the groove with respect to a widthwise direction of the groove (hereinafter it is referred to as "centering".

The centering means is preferably formed by bends provided in the blades.

The bends are preferably formed so as to be away from each other so that when the blades are exposed from the blade groove and are advanced toward the hook, the blades can open their mouth at the front ends thereof.

Preferably, the compound needle is formed as a transferring needle that is designed so that the front ends of the blades of the slider are advanced further beyond the hook to transfer a stitch loop at the advanced position, and the bends are configured so as to narrow the space between the front ends of the blades when the front ends of the blades are advanced to the loop transferring position beyond the hook.

The bends are preferably formed in portions of the blades in which the blades are completely exposed from the blade accommodating groove in the loop transferring position.

Preferably, the compound needle is formed as a transferring needle that is designed so that the front ends of the blades of the slider are advanced beyond the hook to transfer a stitch loop at the advanced position, and the bends are configured so as to be oriented in a direction for them to be pressed to each other so as to narrow the space between the front ends of the blades when the front ends of the two superposed blades are advanced to the loop transferring position beyond the hook.

The centering means is preferably formed as something to bring either upper edges or lower edges of the blades into press-contact with side walls of the blade groove.

The centering means is preferably formed by twists provided in the blades.

According to this invention, in the compound needle comprising the needle body and the slider, the blade parts of the slider are accommodated and supported in the blade groove formed in the needle body. Each blade of the slider is provided with the centering means, and each blade is provided with a bend serving as the centering means formed in a portion thereof that goes in and out from the blade groove. The bends of the blades can bring the side walls of the blades into press-contact with the side walls of the groove so as to correct the out-of-position of the blades to the right or left in the groove resulting from the gaps defined between the blade groove and the blades so as to always place the blades in the center of the groove.

According to this invention, when the slider is moved relative to the needle body in a direction for the hook to be closed by the slider, the blades are centered in the groove.

When the front ends of the tongues are abutted with the front end of the hook, the blades can be forked at the front ends thereof to hold the hook in sandwich relation from both sides thereof to reliably close it.

The centering means is configured so as to bring either of the upper edges and the lower edges of the blades into press-contact with the side walls of the blade groove, and as such can allow the gaps between the blades and the side walls of the blade groove to be filled in so as to center the blades. The tongues at the front ends of the blades are expanded by the action of the twists, and as such can allow the blades to be further reliably forked by the hook.

In the case where the compound needle is formed as a transferring needle that is designed so that the front ends of the blades of the slider can be advanced further beyond the hook, since the bends are configured so as to suppress expansion of the space between the front ends of the blades when the front ends of the blades are advanced to the loop transferring position beyond the hook, even when the knitting members, such as sinkers and loop pressers, are positioned in the vicinity of the compound needles, the knitting problem caused by the blades coming close to the knitting members can be prevented. This can be achieved by the bends of the blades being configured so as to be oriented in a direction for them to be pressed either toward or away from each other.

BEST MODE FOR CARRYING OUT THE INVENTION

Figure 1:
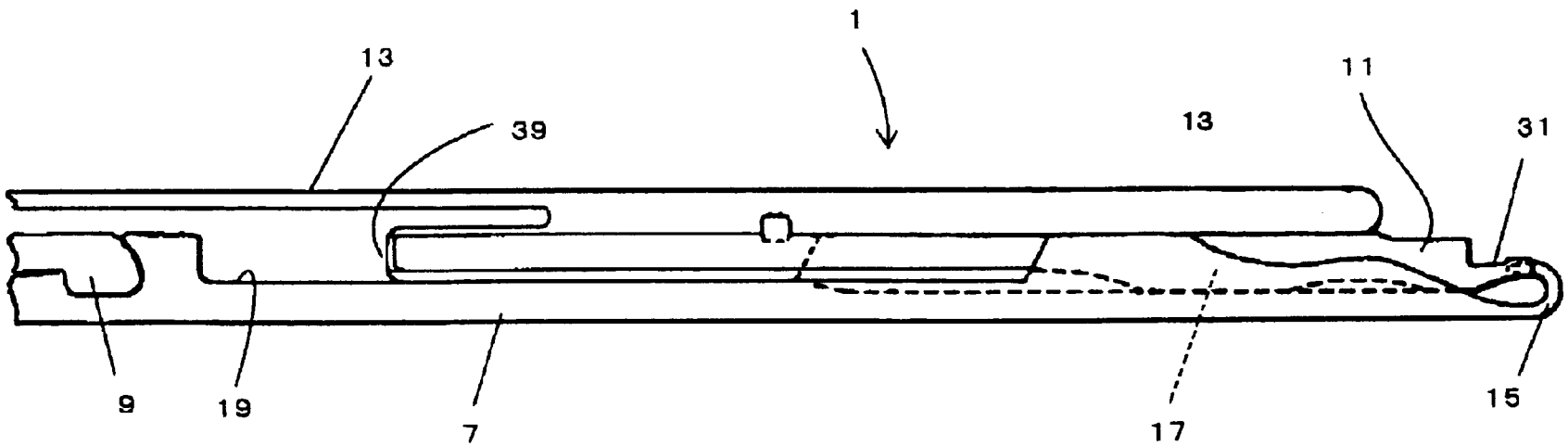
FIG. 1 is a view showing a front end portion of a compound needle according to Embodiment 1 of the present invention, which is in a state of being fitted in a needle groove formed in a needle bed.
Figure 2:
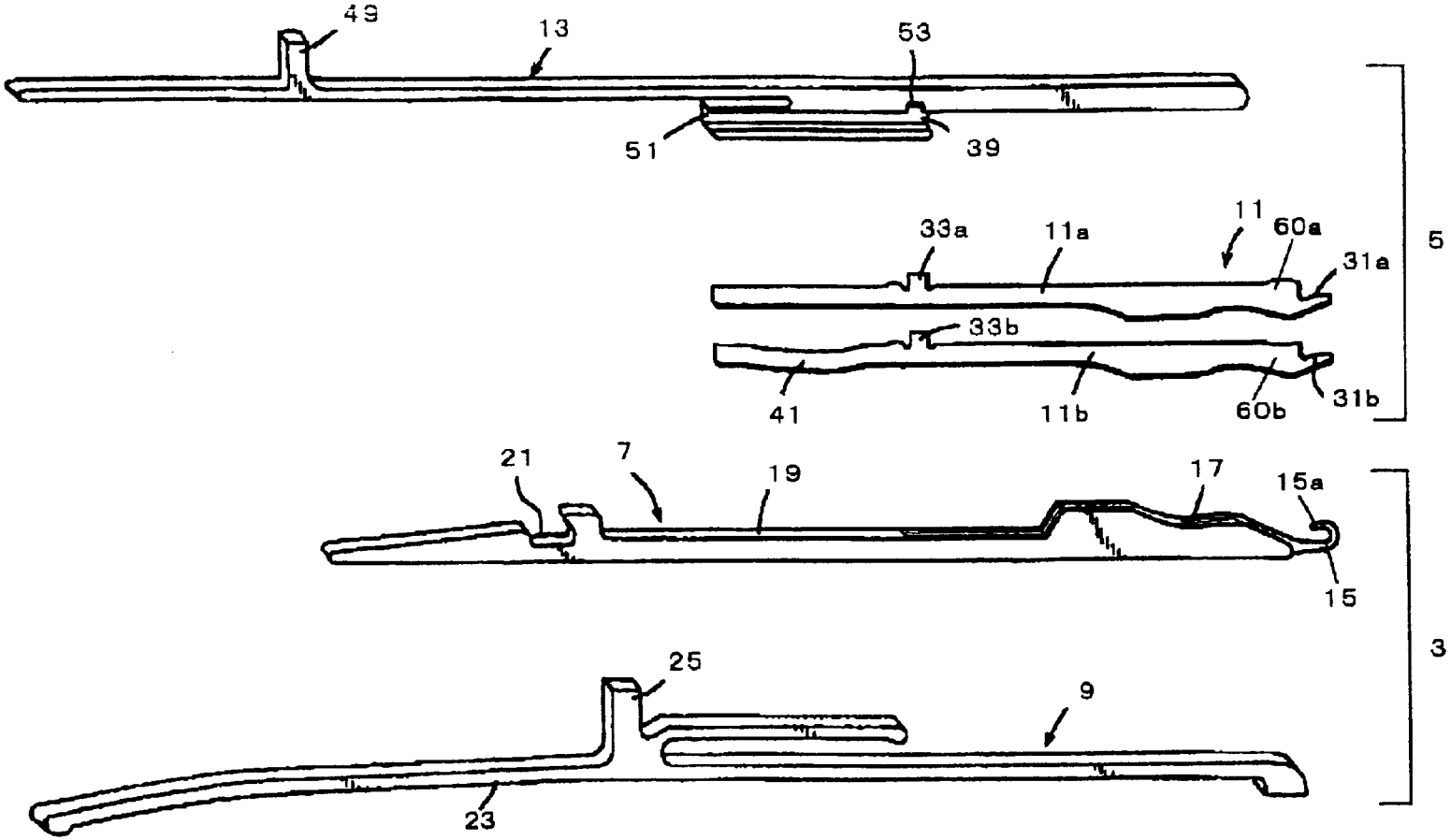
FIG. 2 is a view showing details of components of the compound needle of FIG. 1.

In the following, embodiments of the compound needle of the present invention will be described with reference to the accompanying drawings.

Embodiment 1

A compound needle 1 fitted in a needle groove formed in a needle bed (not shown) comprises a needle body 3 and a slider 5. The needle body 3 comprises a hook member 7 and a jack 9 separate from each other. These may be formed in combination. It should be noted that the needle body 3 defined in the description covers both types of the needle body.

The hook member 7 includes a hook 15, an accommodating groove 17 for accommodating blades 11, a center body portion 19 for supporting a lower arm 39 of a slider body 13, and a recess 21 for a front end of the jack 9 to be linked thereto. These are arranged in order from the front end toward the rear end. The hook 7 and the jack 9 are formed to have the same thickness, which is slightly smaller than width of the needle groove. The jack 9 has a curved elastic leg 23 extending rearward from the recess 21 and having a rear end to abut with a bottom of the needle groove. Also, the jack 9 has a control butt 25 projecting out from near the center portion of the jack to be engaged with a cam provided in a cam carriage (not shown). The forward and backward operation of the jack can allow the needle body 3 to move forward and backward.

The slider 5 comprises blades 11*a,* 11*b* and the slider body 13 separate from each other. The blades 11 are formed by superposing two plates having substantially identical configuration and are accommodated in the blade groove 17. The blades 11 have tongues 31*a,* 31*b* formed at front ends thereof to be abutted with a front end portion 15*a* of the hook and also have coupling portions 33*a,* 33*b* which are formed at rear side of the blade groove 17 and are to be coupled with the slider body 13.

The slider body 13 has a thickness identical with that of the needle body 3 and also has, at a rear side thereof, a control butt 49 projecting out therefrom to control forward and backward movement. 39 designates a lower arm branched from the slider body and formed to extend into an interior of the center body portion 19 of the hook member 7. The lower arm 39 has an elongate groove 51 formed by cutting one side surface of the lower arm and a through hole 53 is formed on the elongate groove 51.

Figure 3:
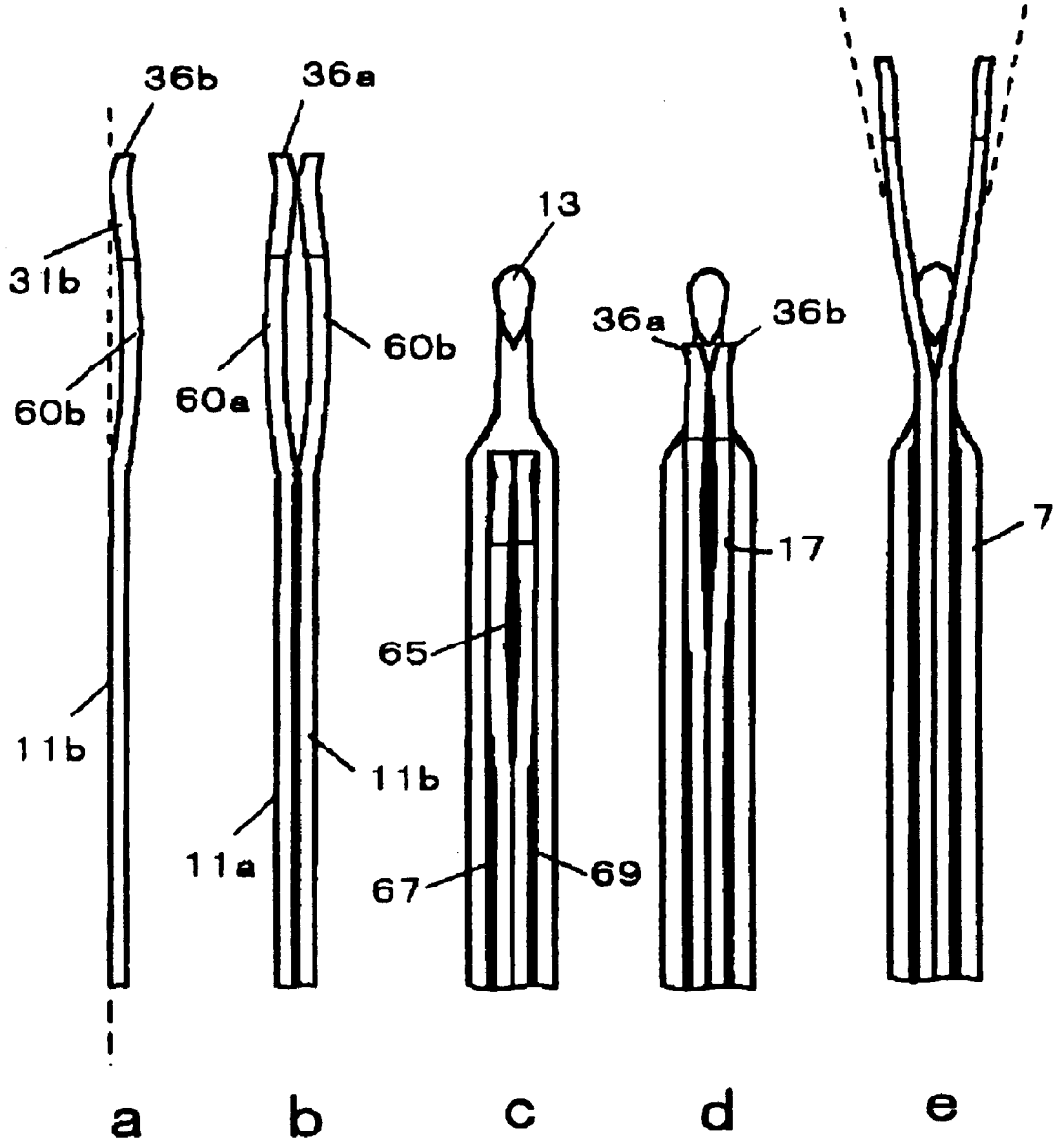
FIG. 3*a* is a view showing one of the blades of a slider taken out from a needle body.
FIG. 3*b* is a view showing laminated blades.
FIG. 3*c–e* are illustrations of a shift of the blades from a retracted position to a loop transferring position.

The projections 33*a,* 33*b* of the blades 11 are fixedly coupled with the through hole 53 in the slider body 13 in a proper manner, such as by caulking. One of the blades 11*a* extending in the elongate groove 51 is bent at a rear end portion there of 41 so as to be in press-contact with a side wall of the needle groove so that the slider 5 can be prevented from moving with the forward and backward movement of the needle body 3. 36*a,* 36*b* designate curved portions formed by the front ends of the blades 11 to be abutted with the hook 15 and bent outward, as illustrated in FIG. 3. The curved portions serve as guide surfaces for the front ends of the blades when forked by the hook.

Symmetrical bends 60*a,* 60*b* are respectively formed on the blades 11*a,* 11*b* as a centering means. The bends 60*a,* 60*b* act to correct displacement of the blade 11 with respect to the widthwise direction of the groove resulting from the gap created between the blade groove 17 and the blades 11*a,* 11*b*, so as to always place the blades in the center of the blade groove. The bends 60*a,* 60*b* are formed so as to be away from each other when the blades 11*a,* 11*b* are laminated to each other, as shown in FIG. 3. Shown in FIG. 3*a* is one of the blades taken out from the needle body. Shown in FIG. 3*b* are the blades in the laminated state. Shown in FIGS. 3*c* to 3*e* are the blades fitted in the blade groove of the needle body. FIG. 3*c* shows the state in which the slider is retracted and the front ends of the blades 11*a,* 11*b* are accommodated in the groove. FIG. 3*d* shows the state in which the blades 11 are moved forward to the front end of the hook. FIG. 3*e* shows the state in which the blades are moved forward to a loop transferring position beyond the hook.

For convenience and understanding of the explanation, the gaps formed in the groove and the bends of the blades are depicted in an exaggerated form in FIG. 3. 65 denotes a gap between the blades 11*a,* 11*b* ; 67 a gap between 11*a* and one side wall of the groove; and 69 a gap between 11*b* and the other side wall of the groove. The bends 60*a*, 60*b* of the blades 11*a*, 11*b* are configured so as to be away from each other and so as to be in press-contact with both side walls of the blade groove 17. By the action of the bends, the blades 11*a*, 11*b* are centered in the groove at positions equally divided to the right and left from a widthwise center of the groove.

Further, the bends 60*a*, 60*b* can act to suppress the outward expansion of the blades 11*a*, 11*b* in the loop transferring state, as shown in FIG. 3*e*. Thus, the provision of the bends can produce suppression of outward expansion of the front ends of the blades, as compared with the conventional type shown by broken line. In a case where the bends are formed in an area such that the bends 60*a*, 60*b* are initially exposed from the groove 17 in the FIG. 3*e* state, as is the case with this embodiment, it is preferable that the width of the space defined between the bends 60*a*, 60*b* in the FIG. 3*b* state should not be made larger than thickness of the hook 15.

Variants and Alteration

Figure 4:
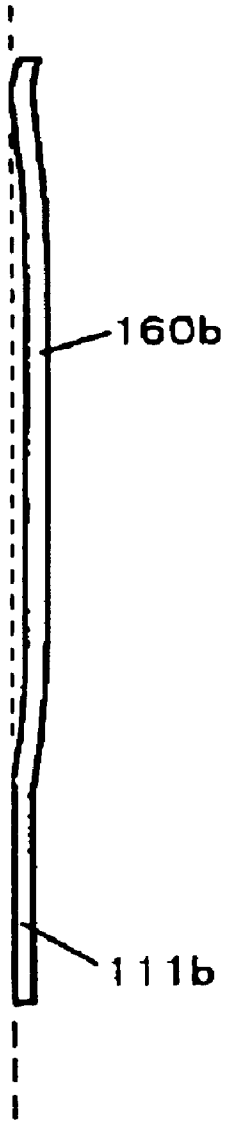
FIG. 4 is a variant of the blade, having a bend curved largely in the longitudinal direction thereof.
Figure 5:
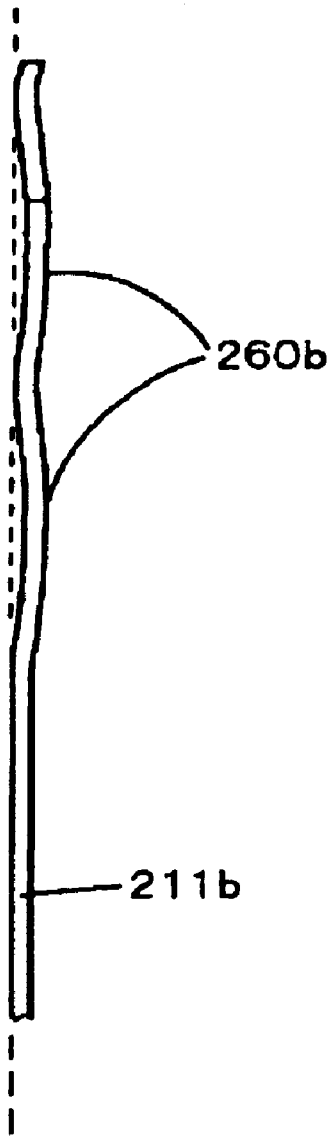
FIG. 5 is another variant of the blade, having two waveform bends.

Referring to FIG. 4, there is shown only one blade 111*b* of a variant having a bend 160*b* that is greatly curved in the longitudinal direction thereof, and corresponds to that shown in FIG. 3*b*. In this variant, a part of the bend stays in the blade groove even in the loop transferring position. Referring to FIG. 5, there is shown a blade 211*b* of another variant having two waveform bends 260*b*. Both types of blades can produce equivalent effects to those of the previous embodiment.

Figure 6:
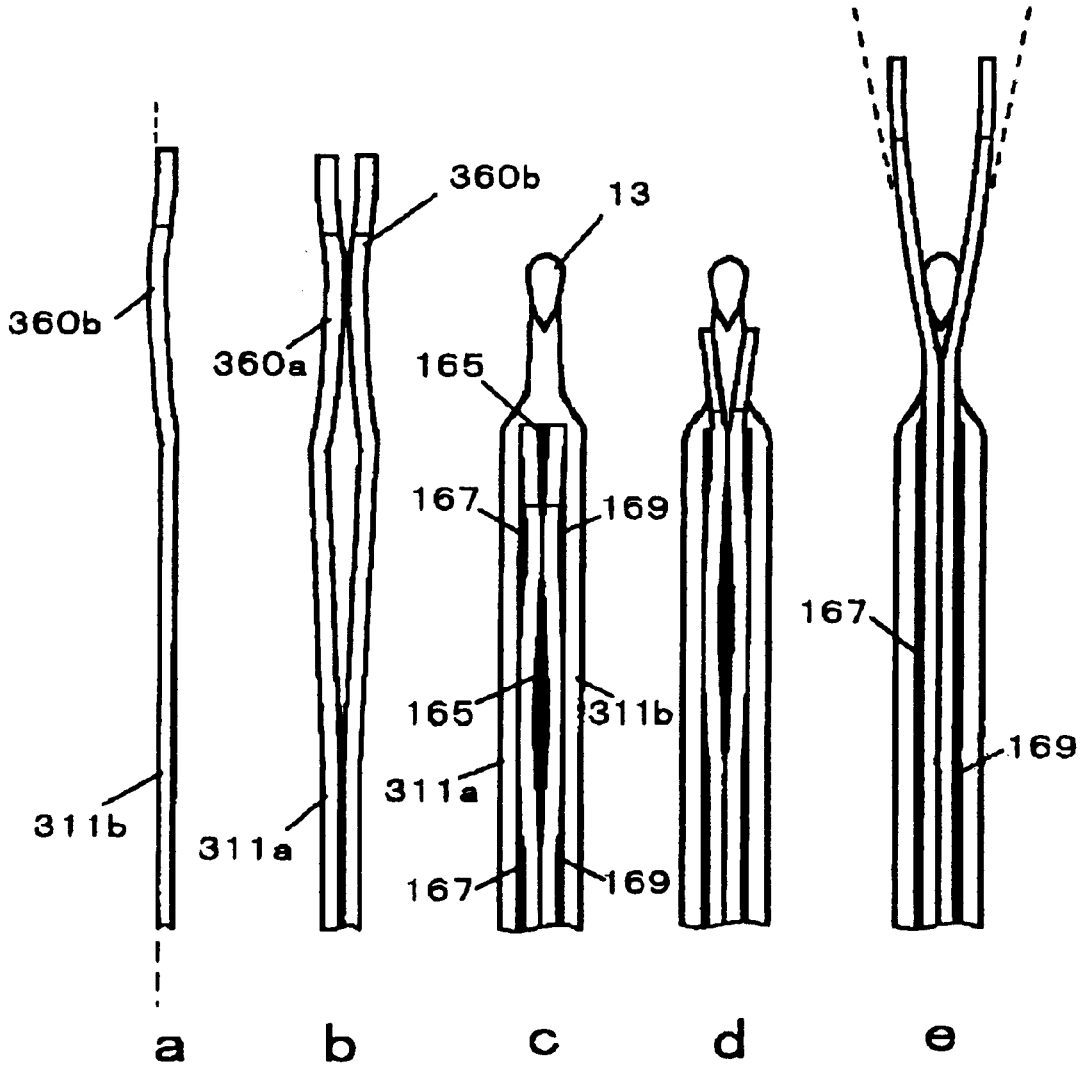
FIG. 6 is a view of an alteration of the compound needle corresponding to that of FIG. 3.

Referring now to FIG. 6, there is shown an alteration of the compound needle. In the alteration, blades 311*a*, 311*b* are provided, at front portions thereof, with bends 360*a*, 360*b* which are configured so as to be pressed to each other when the blades are laminated. FIG. 6 corresponds to FIG. 3 of the previous embodiment. 165 designates a gap between the blades 311*a*, 311*b*. 167 designates a gap between 311*a* and one side wall of the groove. 169 designates a gap between 311*b* and the other side wall of the groove. The bends 360*a*, 360*b* of the blades 311*a*, 311*b* are pressed to each other and, as a result of this, parts of the blades in which no bends are formed are brought into press-contact with the side walls of the blade groove 17. By this action of the bends the blades 311*a*, 311*b* are centered in the groove. Further, in this alteration, the front ends of the blades 311 are expanded by the action of the bends, so that the both blades can easily traverse the hook. For this reason, this alteration can omit the configuration of the previous embodiment in which the blades are provided, at the front ends thereof, with the outward curved guide surfaces 36*a*, 36*b*.

Embodiment 2

Figure 7:
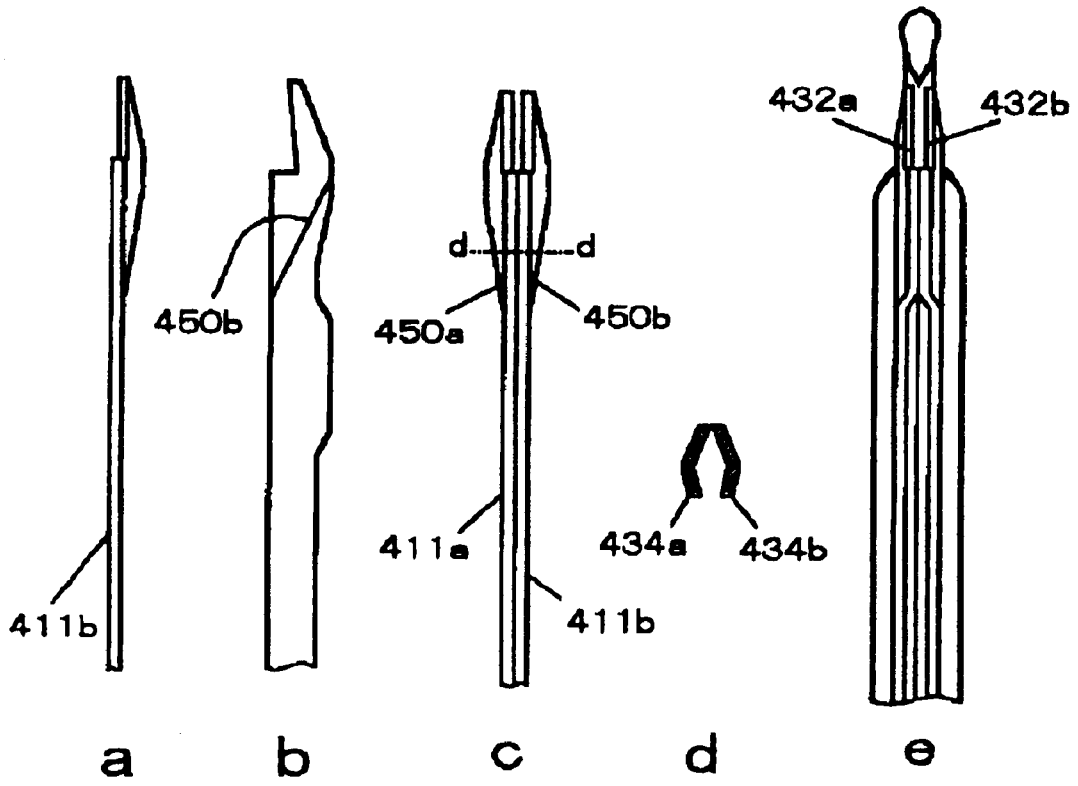
FIG. 7 is a view showing a compound needle according to Embodiment 2 of the present invention.

Next, another embodiment of the compound needle of the present invention will be described with reference to FIG. 7. As the needle body and the slider, except for the blades in this embodiment, are identical in configuration with those of the above-mentioned embodiment, the description thereof is omitted. Shown in FIG. 7*a* is one of the blades 411*a* of the slider, removed from the needle body. Shown in FIG. 7*b* is the other blade 411*b* as viewed from the side. Shown in FIG. 7*c* is the laminated state of the blades of the slider, removed from the needle body. Shown in FIG. 7*d* is a sectional view taken along line d—d of FIG. 7*c*. Shown in FIG. 7*e* is the state in which the blades are moved forward to the hook. 432*a* and 432*b* denote upper surfaces of the tongues and 434*a*, 434*b* denote lower edges of the blades, respectively.

In this embodiment, the centering means for the blades is formed by the blades being twisted along lines 450*a*, 450*b* so that the upper surfaces of the blades can be oriented to the middle of the groove in the state in which the blades are accommodated in the groove and so that the lower edges of the blades can be put into press-contact with the confronting side walls of the groove. This configuration, in which the blades are partly twisted at an angle to a plane parallel to the side walls of the blade groove, enables the gap between the blades and the blade groove to be filled in, so as to center the blades, as is the case with the previous embodiment. Further, in this embodiment, since the tongues at the front ends of the blades are expanded by the action of the twisted blades, as shown in FIG. 7*e*, the blades can be forked by the hook further reliably.

While in the embodiment mentioned above, the blades are twisted at the front end portions thereof so that the upper surfaces of the blades can be oriented to the middle of the groove, alteration of that structure may be adopted wherein coupling portions of the slider body to be coupled with the blades are formed to have tapered surfaces and the blades are coupled with those tapered surfaces. Also, the twisted portions of the blades may be turned upside down so that the lower surfaces of the blades can be oriented to the middle of the groove.

What is claimed is:

1. A compound needle comprising:

a needle body having a hook at a front end thereof a blade groove formed in said needle body;

a slider having tongues that are formed by two superposed blades supported in said blade groove of said needle body, wherein said needle body and said slider can be individually freely moved forward and backward; and centering means for bringing side surfaces of said blades in said blade groove into presscontact with side walls of said blade groove of said needle body and centering said blades with respect to a widthwise direction of said blade groove.

2. The compound needle of claim 1, wherein said centering means comprises bends in said blades.

3. The compound needle of claim 2, wherein said bends are oriented so as to be away from each other such that when said blades are exposed from said blade groove and advanced toward said hook, said blades can open at a mouth of said blades at front ends of said blades.

4. The compound needle of claim 3, wherein said compound needle is formed as a transferring needle designed such that said front ends of said blades of said slider can be advanced beyond said hook to a loop transferring position to transfer a stitch loop at said position and wherein said bends are configured such that a space between said front ends of said blades narrows as said front ends of said blades are advanced to said loop transferring position beyond said hook.

5. The compound needle of claim 4, wherein said bends are formed at portions of said blades that are completely exposed from said blade groove in said loop transferring position.

6. The compound needle of claim 5, wherein said bends are configured such that said bends are pressed together with each other so as to narrow said space between said front ends as said front ends of said blades are advanced to said loop transferring position beyond said hook.

7. The compound needle of claim 1, wherein said centering means brings either upper edges or lower edges of said blades into press contact with the side walls of said blade groove.

8. The compound needle of claim 7, wherein said centering means is formed by twists of said blades.

9. A compound needle comprising:

a needle body having a hook at a front end thereof a blade groove formed in said needle body; and a slider having tongues that are formed by two superposed blades supported in said blade groove of said needle body, wherein said needle body and said slider can be individually freely moved forward and backward;

wherein side surfaces of said blades in said blade groove are in press-contact with side walls of said blade groove of said needle body so as to center said blades with respect to a widthwise direction of said blade groove.

10. The compound needle of claim 9, wherein said side surfaces of said blades in press-contact with said side walls of said blade groove comprise bends in said blades.

11. The compound needle of claim 10, wherein said bends are oriented so as to be away from each other such that when said blades are exposed from said blade groove and advanced toward said hook, said blades can open at a mouth of said blades at front ends of said blades.

12. The compound needle of claim 11, wherein said compound needle is formed as a transferring needle designed such that said front ends of said blades of said slider can be advanced beyond said hook to a loop transferring position to transfer a stitch loop at said position and wherein said bends are configured such that a space between said front ends of said blades narrows as said front ends of said blades are advanced to said loop transferring position beyond said hook.

13. The compound needle of claim 12, wherein said bends are formed at portions of said blades that are completely exposed from said blade groove in said loop transferring position.

14. The compound needle of claim 13, wherein said bends are configured such that said bends are pressed together with each other so as to narrow said space between said front ends as said front ends of said blades are advanced to said loop transferring position beyond said hook.

15. The compound needle of claim 9, wherein said side surfaces of said blades in press-contact with said side walls of said blade groove comprise either upper edges or lower edges of said blades in press contact with said side walls of said blade groove.

16. The compound needle of claim 15, wherein said side surfaces of said blades in press-contact with said side walls of said blade groove comprise twists of said blades.

* * * * *